United States Patent [19]

Phillips, Jr.

[11] Patent Number: 4,518,440

[45] Date of Patent: May 21, 1985

[54] METHOD FOR PASSIVATING STAINLESS STEEL SURFACES AND PRODUCT THEREOF

[75] Inventor: William L. Phillips, Jr., Wilmington, Del.

[73] Assignee: E. I. Du Pont de Nemours and Company, Wilmington, Del.

[21] Appl. No.: 598,930

[22] Filed: Apr. 10, 1984

[51] Int. Cl.[3] ..... C23F 7/04

[52] U.S. Cl. ..... 148/6.14 R; 148/31.5

[58] Field of Search ..... 148/6.14 R, 6.35, 31.5

[56] References Cited

U.S. PATENT DOCUMENTS

| | | | |
|---|---|---|---|
| 1,817,174 | 8/1931 | Brock | 148/6.14 R |
| 2,175,771 | 10/1939 | Giles | 148/6.35 |
| 2,473,456 | 6/1949 | Thurber | 148/6.14 R |
| 2,890,974 | 6/1959 | Carrigan . | |

FOREIGN PATENT DOCUMENTS

| | | | |
|---|---|---|---|
| 7020366 | 7/1970 | Japan | 148/6.14 R |
| 0039185 | 3/1983 | Japan | 148/6.35 |
| 197711 | 11/1977 | U.S.S.R. | 148/6.35 |

OTHER PUBLICATIONS

*The Electrolytical and Chemical Polishing of Metals*, pp. 108–109, 1959, Tegart.

*Trans. Electrochem. Soc.*, vol. 89, pp. 167–194, 1946, Mahla and Nielsen.

*Primary Examiner*—Sam Silverberg

[57] ABSTRACT

Passivated (corrosion resistant) stainless steel surfaces for spinnerets, pack parts, filter media, meter pumps, transfer lines, and the like are achieved by oxidizing the surface in an oxidative atmosphere and subsequently soaking the part in a dilute mineral acid solution.

6 Claims, No Drawings

METHOD FOR PASSIVATING STAINLESS STEEL SURFACES AND PRODUCT THEREOF

BACKGROUND OF THE INVENTION

This invention relates to a method of passivating stainless steel alloys. More particularly it relates to passivating stainless steel surfaces for polymer handling equipment such as spinning pack parts.

While stainless steel alloys by their very nature are considered to be corrosion resistant, it has been found that under certain conditions stainless steels possess a certain reactivity detrimental to the material coming in contact with it. For example, when used for spinnerets to extrude molten polymer through orifices in the spinnerets corrosion products will build up around the edge of the orifices causing polymer drips to form on top of spun filaments adversely affecting the product.

Prior art treatments of spinneret materials have included the use of heat treatment to form a thin oxide coating, increased hardness, and consequently, better corrosion resistance. Tegart points out in his book (*The Electrolytic and Chemical Polishing of Metals,* pp. 108–109, 1959) that Tegart solution, although meant for chemical polishing, when used on alloy steels will result in coating of a passivating film. Mahla and Nielsen (*Trans. Electrochem. Soc.* Vol. 89, pp. 167–194, 1946) treated polished (clean) surfaces in nitric acid, potassium chromate solution and found that such treatment merely delays the onset of corrosive activity.

SUMMARY OF THE INVENTION

It has now been found that by heating the surface of a stainless steel object in an oxidative atmosphere to a temperature of from about 400° F. to about 1250° F. to form a coating of magnetite on the surface then treating the surface with a dilute mineral acid solution at a temperature of from about 20° to 60° C. for at least 30 minutes the surface coating of magnetite ($Fe_3O_4$) converts to ferric oxide ($\alpha$ $Fe_2O_3$) with a chromium to iron ratio of from about 0.5 to about 8.0 with a coating thickness of from about 40 to about 2000 Angstroms.

DETAILED DESCRIPTION OF THE PREFERRED EMBODIMENT

This method is particularly beneficial with stainless steel alloys used to manufacture spinnerets such as type 455 stainless steel which has 11.50 percent chromium 10.25 percent nickel, 0.30 percent titanium, 1.20 percent aluminum, 0.02 percent carbon max and the remainder iron.

In the step of heating the stainless steel in an oxidative atmosphere air is preferable but any oxidative atmosphere may be employed.

It has been found that heating the alloy in a furnace under steam at 950° F. for about three hours then in air for about two hours at 950° F. provides the desired effect. The temperature may vary from 400° F. to 1250° F. and heating time may be varied from 30 minutes to about ten hours. Following the heat treatment the surface of the alloy is treated with a dilute mineral acid solution such as sulfuric acid, oxalic acid, hydrogen peroxide (Tegart's solution) or nitric acid, potassium chromate at relatively low temperatures (20°–60° C.) for relatively short periods of time (30 to 60 minutes).

Chromium enrichment of the surface results from this treatment and is substantiated by X-ray photoelectron spectroscopy (ESCA). In addition, analysis techniques suggest the leaching out of ferrous oxide (FeO) from the heat treated magnetite ($Fe_3O_4$) surface which is a spinel large crystalline size structure to form an unexpected crystal structure change to ferric oxide ($\alpha$ $Fe_2O_3$) which is a continuous ring small crystalline size structure.

EXAMPLE I

A spinneret plate made from type 455 stainless steel was placed in a furnace under steam at 950° F. for three hours then heated in the furnace in air at 950° F. for two hours. The spinneret plate was cut into samples $\frac{1}{8}''$ diameter by $\frac{1}{4}''$ thick. Sample No. 1 was mechanically polished to simulate the mirror finish of a new spinneret. The remaining samples, except for Sample No. 2, were subsequently treated chemically by soaking in Tegart's solution which was a solution of 25 grams oxalic acid (crystals), 13 grams hydrogen peroxide (30%), 1 gram sulfuric acid and 1000 ml of water. An alternate solution of nitric acid and potassium chromate was also used. The time and temperature of the chemical treatment was varied and is indicated in Table I.

TABLE 1

| Sample No. | Solution | Temp °C. | Time min | O | Fe | Cr | Cr/Fe |
|---|---|---|---|---|---|---|---|
| 1 | (polished no treatment) | | | 0.185 | 0.010 | 0.007 | 0.700 |
| 2 | oxidized only | | | 0.321 | 0.0340 | 0.003 | 0.088 |
| 3 | Tegart's | room | 10 | 0.304 | 0.0239 | 0.0079 | 0.330 |
| 4 | Tegart's | room | 30 | 0.320 | 0.0210 | 0.0108 | 0.514 |
| 5 | Tegart's | room | 60 | 0.318 | 0.0160 | 0.0140 | 0.875 |
| 6 | Tegart's | 60 | 30 | 0.5054 | 0.0248 | 0.0318 | 1.280 |
| 7 | Tegart's | 60 | 60 | 0.8417 | 0.0215 | 0.1699 | 7.902 |
| 8 | Tegart's without hydrogen peroxide | room | 60 | 0.4502 | 0.0180 | 0.0282 | 1.570 |
| 9 | 5% nitric acid 0.5% chromic acid | 60 | 60 | 0.431 | 0.0325 | 0.0208 | 0.64 |
| 10 | 10% nitric acid 2% chromic acid | 60 | 60 | 0.368 | 0.0312 | 0.0204 | 0.60 |

TABLE 1-continued

| Sample No. | Solution | Temp °C. | Time min | O | Fe | Cr | Cr/Fe |
|---|---|---|---|---|---|---|---|
| 11 | 5% nitric acid 0.5% chromic acid 30% hydrogen peroxide | 60 | 60 | 0.452 | 0.0398 | 0.0208 | 0.54 |

In a test using spinnerets passivated according to the invention the number of spinnerets with startup drips was reduced from 90% (nonpassivated) to 6% (passivated) and the startup yield increased from 40% (nonpassivated) to 95% (passivated).

EXAMPLE II

In a similar manner various stainless steel alloys representing different spinning machine parts were also treated. In each case two samples ⅛" diameter by ¼" thick were prepared. Both samples were heated in an oxidizing atmosphere in the presence of polymer flake (nylon). One sample was subsequently chemically treated; the other sample was not chemically treated.

Samples 12*a* and 12*b* of SS DP-1 (35% Cr, 3% Si, 0.1% C max, remainder Fe) representing filter media were heated in a steam atmosphere at 950° F. for three hours followed by heating in air at 950° F. for two hours. Subsequently sample 12*b* was chemically treated in Tegart's solution which consists of 25 gm oxalic acid, 13 gm hydrogen peroxide (30%), 1 gm sulfuric acid and 1000 ml of water, for one hour at room temperature.

Samples 13*a* and 13*b* of SS H-11 (5.00% Cr, 1.50% Mo, 0.40% V, 0.35% C, remainder Fe) representing pack parts such as sand holders, distributor plates, and top hats were heated in a steam atmosphere at 950° F. for three hours followed by heating in air at 950° F. for two hours. Subsequently, sample 13*b* was chemically treated in Tegart's solution which consists of 25 gm oxalic acid, 13 gm hydrogen peroxide (30%), 1 gm sulfuric acid and 1000 ml of water, for one hour at room temperature.

Samples 14*a* and 14*b* of SS D-2 (12.00% Cr, 1.00% Mo, 1.00% V, 1.50% C, remainder Fe) representing meter pumps were heated in a steam atmosphere at 950° F. for three hours followed by heating in air at 950° F. for two hours. Subsequently, sample 14*b* was chemically treated in Tegart's solution which consists of 25 gm oxalic acid, 13 gm hydrogen peroxide (30%), 1 gm sulfuric acid and 1000 ml of water, for one hour at room temperature.

Samples 15*a* and 15*b* of SS 304 (18–20% Cr, 8–10.50% Ni, 0.08% C, 2.0% Mn, 1.0% Si, 0.045% P, 0.030% S, 0.10% N, remainder Fe) representing transfer lines were heated in a steam atmosphere at 950° F. for three hours followed by heating in air at 950° F. for two hours. Subsequently sample 15*b* was chemically treated in Tegart's solution which consists of 25 gm oxalic acid, 13 gm hydrogen peroxide (30%), 1 gm sulfuric acid and 1000 ml of water, for one hour at room temperature.

Elemental analysis and Cr/Fe ratio were determined for all samples and are shown in Table II.

TABLE II

| Sample No. | | O | Fe | Cr | Cr/Fe |
|---|---|---|---|---|---|
| 12a | oxidized | 0.6914 | 0.0148 | 0.0683 | 4.614 |
| b | passivated | 1.0855 | — | 0.1423 | ∞ |
| 13a | oxidized | 0.314 | 0.034 | 0.001 | 0.029 |
| b | passivated | 0.340 | 0.014 | 0.015 | 1.072 |
| 14a | oxidized | 0.324 | 0.038 | 0.003 | 0.078 |
| b | passivated | 0.341 | 0.017 | 0.016 | 0.941 |
| 15a | oxidized | 0.218 | 0.041 | 0.002 | 0.048 |
| b | passivated | 0.240 | 0.021 | 0.024 | 1.142 |

The elemental surface content for the above Examples was determined by X ray photoelectron spectroscopy using a Du Pont Model 650 B Electron Spectrometer according to the general procedures outlined in the *Handbook of X Ray Photoelectron Spectroscopy* (1979) by C. D. Wagner, W. M. Riggs, L. E. Davis, J. F. Moulder, and G. E. Muilenberg (Editor) published by Perkins-Elmer Corporation. Integrated intensities are obtained as described in the "Handbook". These intensities are corrected by sensitivity factors (photoionization cross section factors) as published by J. H. Scofield, *Journal of Electron Spectroscopy and Related Phenomena,* 8 (1976) 129–137. The corrected intensities approximate the relative atom abundances for homogeneous surfaces.

I claim:

1. A method for treating the surface of a stainless steel object comprising in sequence heating said object in an oxidative atmosphere to a temperature of from about 400° F. to about 1250° F. to form a coating of magnetite on said surface, treating said surface with a dilute mineral acid solution and forming a coating of ferric oxide on said surface having a chromium to iron ratio of from about 0.5 to about 8.0.

2. The method of claim 1 wherein said stainless steel comprises 11.50 percent chromium 10.25 percent nickel, 0.30 percent titanium, 1.20 percent aluminum, 0.02 percent carbon maximum and the remainder iron, said temperature being about 950° F., said mineral acid solution comprising oxalic acid, sulfuric acid, hydrogen peroxide and water.

3. The method of claim 1 wherein said heating step is at least 30 minutes.

4. The method of claim 1 or 2 wherein said stainless steel object is treated in dilute mineral acid at a temperature of about 60° C. for a period of from about 30 minutes to about 1 hour.

5. The method of claim 1, wherein said stainless steel object is treated in dilute mineral acid at room temperature for at least 30 minutes.

6. A stainless steel object in contact with a polymer having a surface coating comprising ferric oxide and having a chromium to iron ratio of from about 0.5 to about 8.0.

* * * * *